US007408846B2

(12) United States Patent
Brodmann

(10) Patent No.: US 7,408,846 B2
(45) Date of Patent: Aug. 5, 2008

(54) ORNAMENTAL ARTICLE

(76) Inventor: Fredi Brodmann, 55 Clifton Ter., Weehawken, NJ (US) 07086

( * ) Notice: Subject to any disclaimer, the term of this patent is extended or adjusted under 35 U.S.C. 154(b) by 152 days.

(21) Appl. No.: 11/077,869

(22) Filed: Mar. 11, 2005

(65) Prior Publication Data

US 2006/0203621 A1 Sep. 14, 2006

(51) Int. Cl.
*G04B 19/06* (2006.01)
*G04B 19/08* (2006.01)
*G04B 19/10* (2006.01)

(52) U.S. Cl. ..... 368/228; 368/281

(58) Field of Classification Search ..... 368/80, 368/88, 228, 232, 276, 281, 282, 285
See application file for complete search history.

(56) References Cited

U.S. PATENT DOCUMENTS 1,210,771 A * 1/1917 Depollier ..... 368/277
1,740,427 A * 12/1929 Kislinger ..... 368/285
2,066,437 A * 1/1937 Vitrone ..... 368/279
3,262,258 A * 7/1966 Poynter ..... 368/80
4,117,662 A * 10/1978 van der Lely ..... 368/279
4,130,987 A * 12/1978 Schickedanz ..... 368/29
4,412,751 A * 11/1983 Jeannet et al. ..... 368/276
D322,227 S * 12/1991 Warhol ..... D10/32
D471,471 S * 3/2003 Fu et al. ..... D10/32
6,619,836 B1 * 9/2003 Silvant et al. ..... 368/281
6,883,961 B1 * 4/2005 Ray ..... 368/281
2002/0012292 A1 * 1/2002 Mitamura ..... 368/281
2004/0130973 A1 * 7/2004 Hartje ..... 368/281

* cited by examiner

*Primary Examiner*—P. Austin Bradley
*Assistant Examiner*—Jeanne-Marguerite Goodwin
(74) *Attorney, Agent, or Firm*—Lucas & Mercanti, LLP

(57) ABSTRACT

The ornamental article is a bangle or ring which can house a watch or item of jewelry. The article has two or more planar portions fixed at a 90° angle and a display area that spans the surface of at least two of the planar portions to form a continuous angled display area.

8 Claims, 4 Drawing Sheets

ORNAMENTAL ARTICLE

BACKGROUND OF THE INVENTION (1) Field of Invention

The present Invention relates to an ornamental article for personal use which can be worn on the wrist, ankle or finger. More particularly, the present Invention relates to a bracelet, anklet, wrist watch or ring which is worn on the wrist, ankle, finger or toe.

(2) Related Art

Bracelets and anklets are ornamental bands or chains which are worn around the wrist or ankle, respectfully. They can take a variety of shapes.

Wrist watches are generally circular in shape and comprise a single planar housing which houses the watch mechanism and a band which is coupled at both ends of the housing and is used to secure the watch to the wrist of the user. Rings are generally circular in shape and are worn on the finger or the toe, but can take on other shapes besides circular.

There is always a need for a new and useful ornamental article that can be worn on the wrist, ankle, finger or toes.

SUMMARY OF THE INVENTION

A new ornamental article for personal use in displaying useful or decorative matter has now been invented. The article of the present Invention has at least two planar portions which are rigidly affixed to one another at a selected angle wherein at least two of the planar portions have an outward facing display area for displaying useful and/or decorative matter. Affixed to the planar portions is a band which is used to couple the planar portions to the wrist, ankle, finger or toe of the user. The band or coupling means can be continuous or have a latch mechanism that opens and closes. The ornamental article of the present Invention can be called a bangle.

Preferably, there are three planar portions each of which are rigidly connected to each other at selected rigid angles relative to each other, however, two planar portions may be easier for manufacturing and therefore also preferred. Preferably the rigid angle is about 90°.

It is also preferred that the display area which is on the outside of the planar portion extend from one planar portion onto another of the planar portions so as to create a single, angled display area which forms approximately a 90° angled display area. The display area can also extend onto a third planar portions and thereby form an inverted U-shaped display area which spans three planar portions.

The display areas on the article suitably display gemstones, an ornamental design, the face of an electronic apparatus such as a watch, cell phone or calculator or display other ornamental matter such as a precious metal or a favorite picture or saying.

The planar portions have a thickness which is suitable for housing the working mechanisms of the electronic apparatus or simply for providing an appearance to the ornamental design itself. The thickness, however, can be relatively thin to highlight that portion of the user's body on which it is worn.

The width of the planar portions can likewise vary depending on the display or decorative portion which is being displayed. For example, in the case of a watch face, the width would be on the order of 3 centimeters so as to fully display the watch face.

The coupling means, which are used to affix the planar portions to the user's body, are attached at each side of the planar portions so as to form a continuous loop. The coupling means is preferably flexible so as to conform to the user's body, however, the coupling means can also be rigid. The coupling means may include, for example, a leather or cloth band which is affixed at both ends to the planar portions or it may be divided in half and affixed at one end to the planar portions and a latch mechanism at the other end for forming the continuous loop. The latch mechanism may be open/snap closure, a hook and eye, or other conventional watch/jewelry latch mechanisms.

The present Invention can also be defined as a watch, comprising a housing;

a crystal disposed in said housing, having a first planar portion and a second planar portion, wherein the first and second planar portions are affixed to each other at an angle of about 90°; and a band coupled to said housing.

The watch can have a flexible band or a rigid band.

The watch can further comprise a hinge, wherein said hinge couples said band to said housing. The band can be substantially U-shaped.

These and other aspects of the present Invention can be more fully understood by reference to one or more of the following drawings which are chosen for illustration purposes only.

DETAILED DESCRIPTION OF THE INVENTION

Figures 1A, 1B:
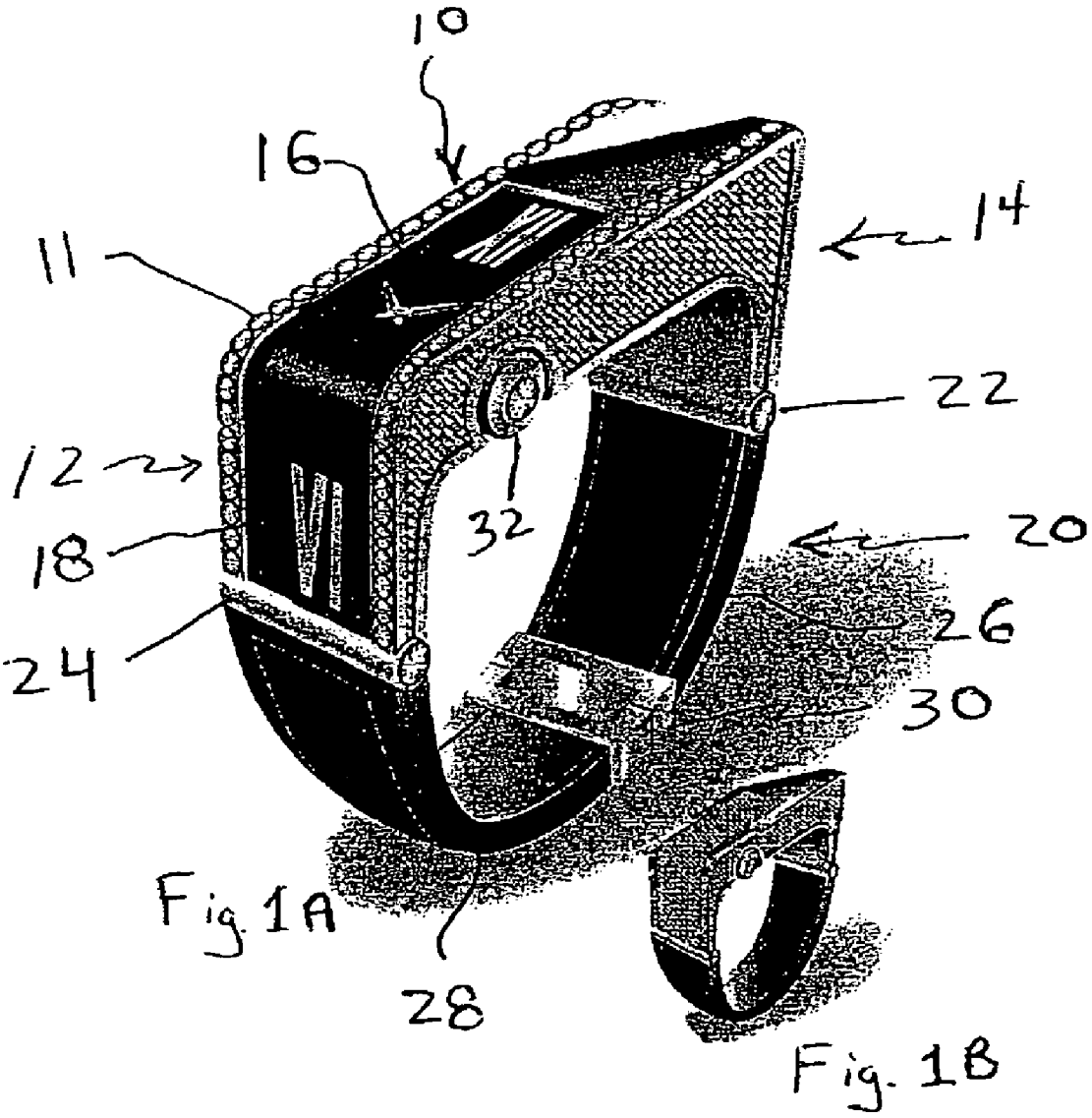
FIG. 1A illustrates a perspective view of one embodiment of the present Invention as a watch.
FIG. 1B illustrates a perspective view of the present Invention as a ring.

As shown in FIG. 1A, a wrist watch made in accordance with one embodiment of the present Invention is illustrated. The article of FIG. 1A is illustrated with three planar portions, top planar portion 10, front planar portion 12 and back planar portion 14. Both front planar portion 12 and top planar portion 10 have display areas, namely, top display area 16 and front display area 18. In FIG. 1A, these display areas illustrate the face of a watch, however, other ornamental or decorative elements 11 can be displayed in these display areas.

FIG. 1B illustrates a ring with precious metal in the display areas.

In the embodiment shown in FIGS. 1A and 1B, the planar portions are rigidly fixed to one another at approximately 90°.

Band 20 is a flexible band which is used to attach the planar portions to the wrist of the user. Band 20 is attached to the planar portions by back hinge 22 and front hinge 24. Band 20 is divided into two half bands, back half band 26 and front half band 28, by latch 30. Latch 30 allows for opening and closing of the band.

Watch stem 32 is illustrated in FIG. 1A for adjusting the hands of the watch.

Figure 2:
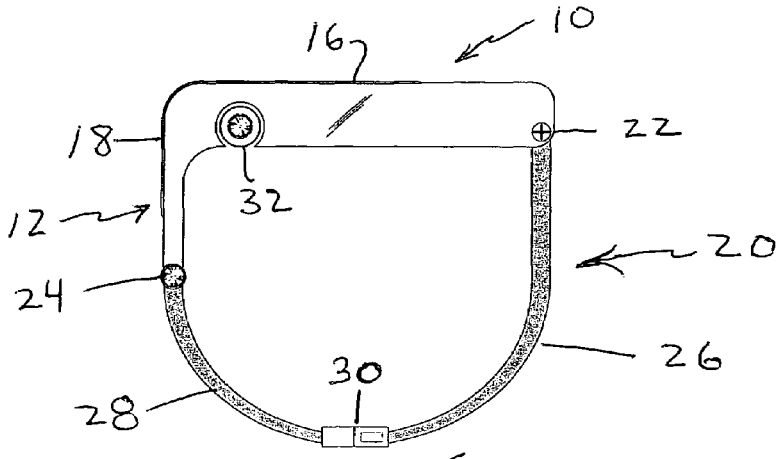
FIG. 2 illustrates a variation of the present Invention.

FIG. 2 illustrates a variation to the ornamental article of the present Invention in that band 20 is connected by back hinge 22 directly to top planar portion 10, instead of back planar portion 14 as shown in FIG. 1A.

Figure 3:
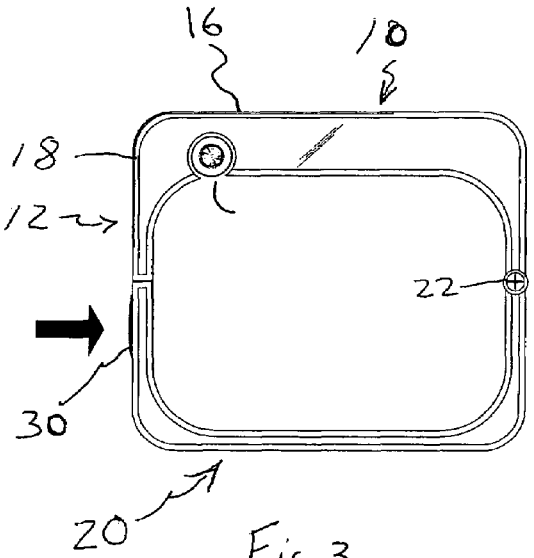
FIGS. 3 and 4 illustrate yet another variation of the present Invention.
Figure 4:
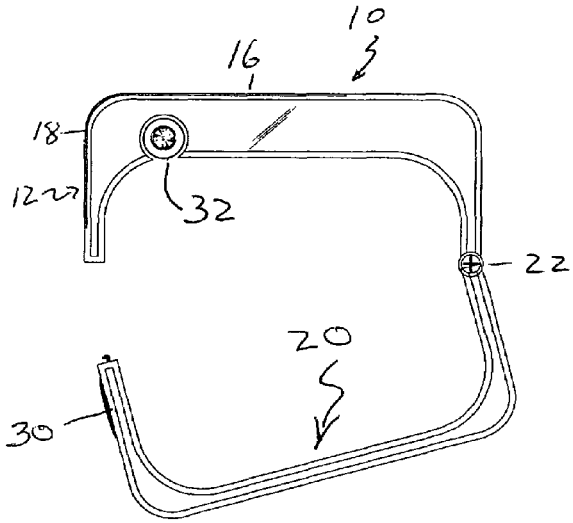

FIGS. 3 and 4 illustrate a variation of the present Invention wherein band 20 is rigid and latch 30 has replaced front hinge 24. FIG. 3 illustrates latch 30 and band 20 in a closed position. Latch 30 is pressed to open, and FIG. 4 illustrates latch 30 and band 20 in an open position.

The thickness of top planar portion 10 can vary depending on the mechanism which it is intended to house. FIGS. 1A and 2-11 illustrate a watch mechanism which may be housed in planar portion 10 and, thus, the thickness is such so as to facilitate the watch mechanism. Naturally, the thickness can vary depending on the mechanism housed or the aesthetic image which is displayed in the displayed areas.

The width of the planar portions can likewise vary depending on the display area and what items are to be displayed. In the case of a watch face, the size will vary in order to facilitate the face of a watch. In the case of an item of jewelry like a gemstone or precious metal, the width can vary depending on the amount or size of the gems or precious metal which is to be displayed.

Figure 5:
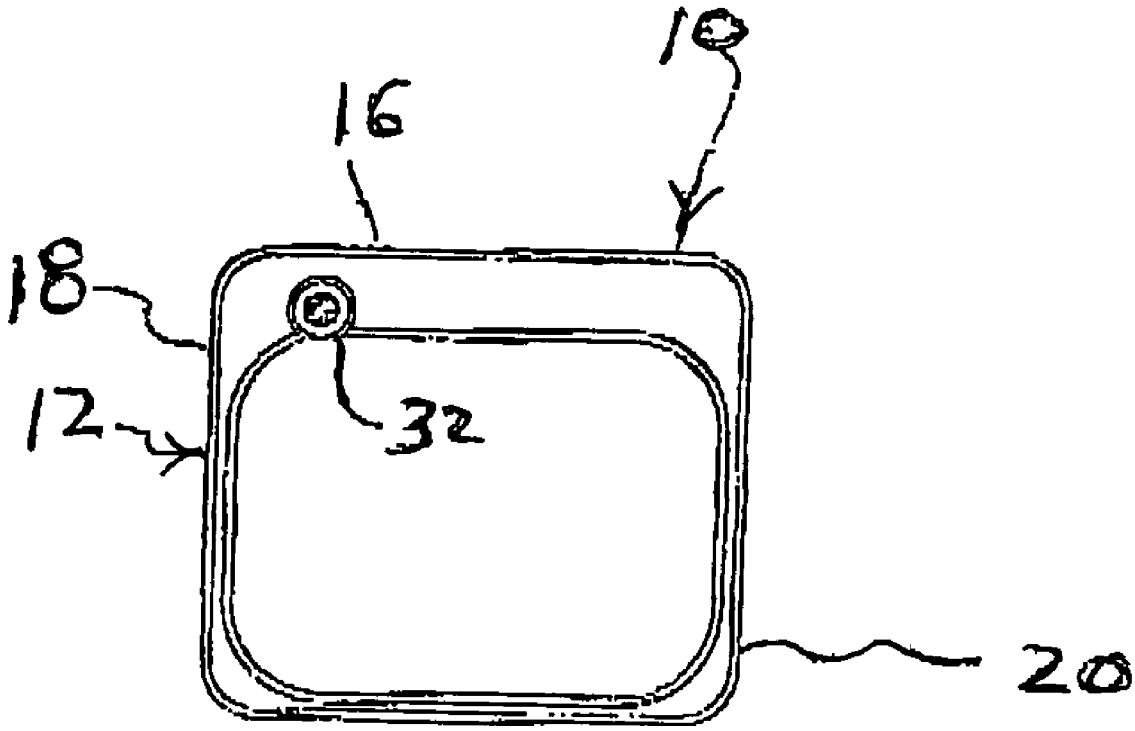
FIG. 5 illustrate a further variation of the present Invention.
Figure 6:
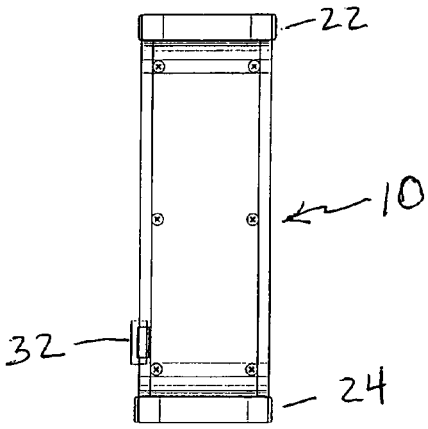
FIGS. 6-11 illustrate back, front and side views of the present Invention of FIG. 1, FIG. 6 as a back view.
Figure 8:
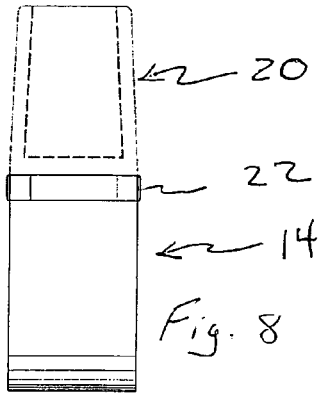
Figure 7:
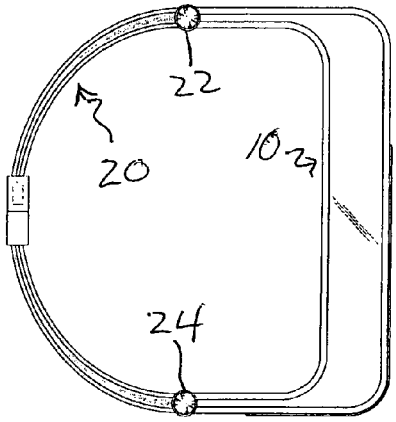
Figure 9:
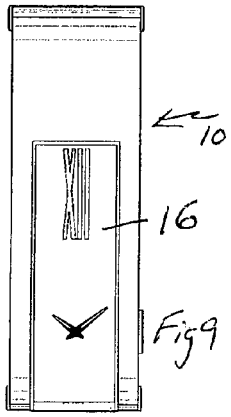
Figure 11:
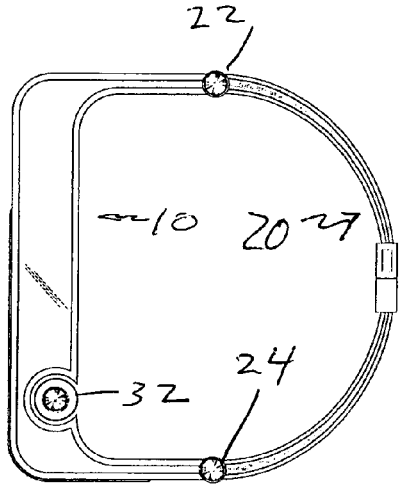
Figure 10:
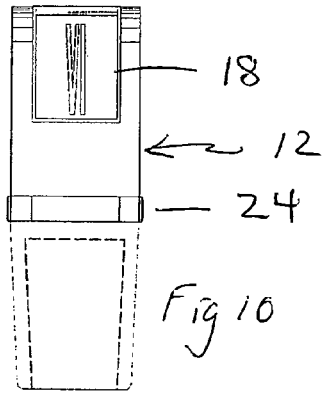

Band 20 can take on a variety of shapes and configurations as shown in the Figures. Preferably, band 20 is flexible in order to conform to a portion of the user's body to which it is affixed. An alternative embodiment is shown in FIG. 5, in which band 20 is fixedly attached to the planar portions such that it forms a solid article which slips onto the user's wrist or finger.

Suitably, the outside of band 20 is decorated in such a manner as to match the outside of the planar portions.

It will be understood that the claims are intended to cover all changes and modifications of the preferred embodiments of the Invention herein chosen for purposes of illustration which do not constitute a departure from the spirit or scope of the Invention.

What I claim is:

1. An analog watch, comprising:

a rigid housing having a first planar portion and a second planar portion, wherein the first and second planar portions are rigidly affixed to each other at about a 90° angle;

a rigid crystal disposed in said housing, said crystal being a single continuous unit covering said first planar portion and said second planar portion;

a rigid display with a hour hand, a minute hand and numerical indicia corresponding to an analog watch face disposed in said housing, said display being a continuous single unit having about a 90° angle; wherein, said hour hand, said minute hand and a full sweeping area of said hour hand and said minute hand are all located on said first planar portion and some of the numerical indicia of the analog watch face are located on said first planar portion and remaining numerical indicia of said analog watch face are located on said second planar portion; and a band coupled to said housing.

2. The watch of claim 1, further comprising an item of jewelry displayed on at least one of said planar portions.

3. The watch of claim 2, wherein said item of jewelry comprises a gemstone or precious metal.

4. The watch of claim 2, wherein said band comprises a loop adapted to fit over the person's finger as a ring.

5. The watch of claim 1, wherein said band is flexible.

6. The watch of claim 1, wherein said band is rigid.

7. The watch of claim 6, further comprising: a hinge, wherein said hinge couples said band to said housing.

8. The watch of claim 7, wherein said band is substantially U-shaped.

* * * * *